United States Patent [19]

Freibergs et al.

[11] 4,382,261

[45] May 3, 1983

[54] PHASE SHIFTER AND LINE SCANNER FOR PHASED ARRAY APPLICATIONS

[75] Inventors: Elmer Freibergs, Toms River; Robert E. Horn, Middletown; Harold Jacobs, West Long Branch, all of N.J.

[73] Assignee: The United States of America as represented by the Secretary of the Army, Washington, D.C.

[21] Appl. No.: 146,560

[22] Filed: May 5, 1980

[51] Int. Cl.[3] ..... H01Q 3/26

[52] U.S. Cl. ..... 343/854; 343/701; 343/754

[58] Field of Search ..... 343/754, 756, 854, 909, 343/910, 911 R, 911 L

[56] References Cited

U.S. PATENT DOCUMENTS

| | | | |
|---|---|---|---|
| 2,921,308 | 1/1960 | Hansen et al. | 343/754 |
| 3,155,975 | 11/1964 | Chatelin | 343/873 |
| 3,959,794 | 5/1976 | Chrepta et al. | 343/754 |
| 3,969,729 | 7/1976 | Nemit | 343/854 |
| 4,203,117 | 5/1980 | Jacobs et al. | 343/754 |
| 4,212,014 | 7/1980 | Chekroun | 343/754 |

*Primary Examiner*—David K. Moore

*Attorney, Agent, or Firm*—Nathan Edelberg; Jeremiah G. Murray; John W. Redman

[57] ABSTRACT

A millimeter wave line scanner is disclosed providing steered fan-shaped beams from opposite faces at substantially equal angles of a semiconductor waveguide, rectangular in cross section, and having a plurality of equally spaced metallic perturbations or strips disposed on one of the two radiating sides or faces. Different angles of scan are selectively obtained by means of at least one distributed longitudinal PIN diode formed on an adjoining side of the semiconductor waveguide having electrical circuit means coupled thereto for controlling the diode's conductivity which acts to change the guide wavelength and accordingly cause a variation in radiation angle of the two equal beams radiating from opposite faces. The waveguide with one or more PIN diodes may also be used as a phase shifter. To reduce losses, a dielectric insulating layer is disposed between each PIN diode and the waveguide, which prevents the propagation of the wave into the PIN diode.

5 Claims, 5 Drawing Figures

PHASE SHIFTER AND LINE SCANNER FOR PHASED ARRAY APPLICATIONS

The invention described herein may be manufactured and used by or for the Government for governmental purposes without the payment of any royalties thereon or therefor.

REFERENCE TO RELATED PATENTS

This application is related to U.S. patent application Ser. No. 946,687 filed Sept. 28, 1978, now U.S. Pat. No. 4,203,117; by H. Jacobs and R. E. Horn, two of the present inventors; which is hereby incorporated by reference and made a part hereof as though fully set forth, for essential matter. U.S. Pat. No. 3,959,794 is also incorporated by reference.

BACKGROUND OF THE INVENTION

This invention relates to line scanners operating in the millimeter wave region, and more particularly to a semiconductor waveguide line scanner.

The background is set forth in said prior application and the references cited therein. We are not aware of any more pertinent prior art or other material information.

In the previous work, phase shifters have been disclosed in which the wavelength in a dielectric waveguide such as high resistivity silicon can be changed by attaching a semiconductor distributed PIN diode. Phase and amplitude changes were measured in a bridge at about 60 gigahertz. When the diode is conductive, the wavelength changes and hence phase measurements indicate a phase change. While this represents a significant advance in the state of the art, there is a difficulty that in some cases the change in attenuation is also high and the loss in electromagnetic energy is undesirably high for practical use.

SUMMARY OF THE INVENTION

The object of the invention is to decrease the losses while at the same time maintain an adequate change in wavelength for phase shifting.

The invention relates to use of a dielectric layer under the PIN modulator.

The low loss, low permittivity insulator layer prevents the propagation of the electromagnetic wave into the modulator and decreases the loss.

DETAILED DESCRIPTION

Figure 1:
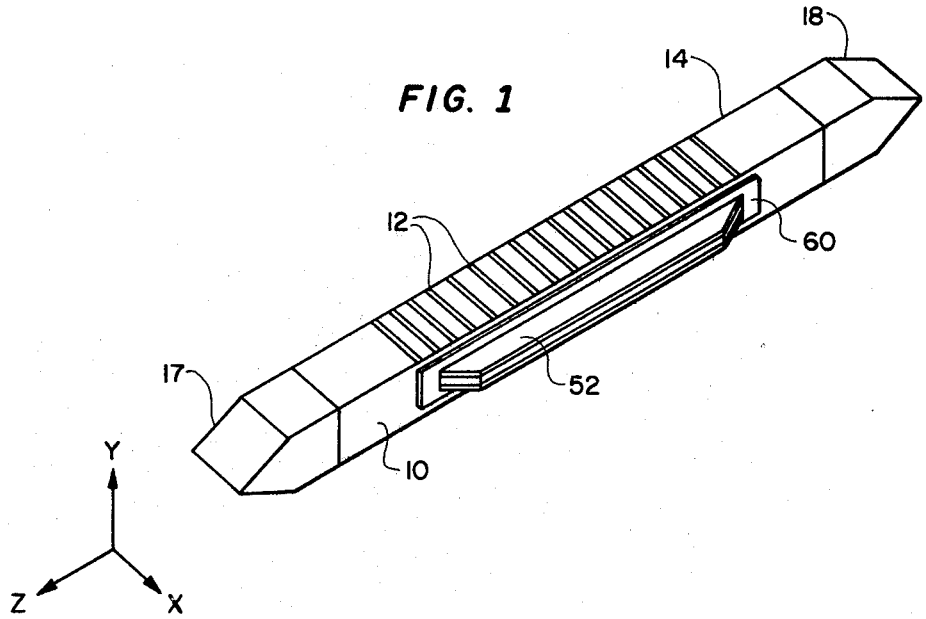
FIG. 1 is a perspective view of a preferred embodiment of the subject invention.

The basic configuration of a dual beam line scanner is described in said Jacobs et al copending patent application. It comprises an intrinsic single crystal semiconductor waveguide element provided with a plurality of uniformly spaced parallel metallic strips or perturbations preferably comprised of copper disposed on one face or surface of the semiconductor waveguide transverse to the longitudinal and propagation axis Z. FIG. 1 herein shows such a waveguide 10 with metallic strips 12 on face 14. It may be comprised of 10,000-ohm per cm. silicon. Unless otherwise stated, all dimensions and other parameters are as given by Jacobs et al. When used as a phase shifter, the perturbations 12 are omitted, so that the R.F. energy is not radiated.

Jacobs et al shows tapered ends which terminate in input and output metal waveguides. Alternatively the ends 17 and 18 may be of aluminum oxide ($Al_2O_3$) tapered to a point as shown in FIG. 1 to act as a transformer of wider bandwidth. It terminates in waveguides in the same manner as shown by Jacobs et al.

Figure 2:
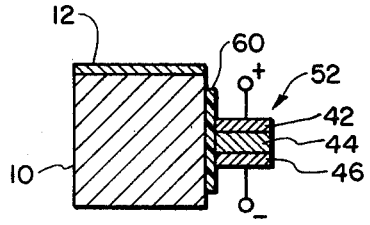
FIGS. 2 and 3 are transverse cross sectional views of two embodiments of FIG. 1, with FIG. 2 showing one PIN diode, and FIG. 3 showing two PIN diodes on opposite faces.
Figure 3:
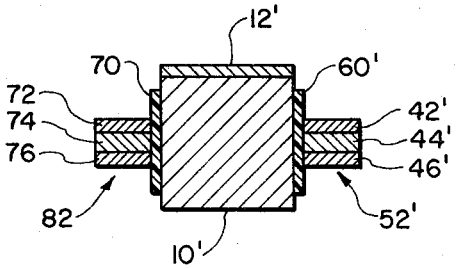

FIG. 2 is a cross section view of the waveguide of FIG. 1. With a direction of propagation down to the left in FIG. 1, or toward the viewer in FIG. 2, the electric field vector E is upward in the Y direction. These views show a single PIN diode 52 modulator. FIG. 3 shows an embodiment with a double modulator, having two PIN diodes 52' and 82 on opposite faces, either opposite each other or staggered. The staggered arrangement is more immune to moding and potentially less lossy than the arrangement of the two directly opposite.

The dielectric layer added under the PIN diodes is a low loss, low permittivity insulator 60 in FIGS. 1 and 2. In FIG. 3, insulator 60' is placed under diode 52', and insulator 70 is placed under diode 82. The insulating layer may be used also with any of the embodiments shown by Jacobs et al to separate the PIN diodes from the waveguide.

The technique of utilizing an insulating layer has been applied successfully on both a PIN diode phase shifter, and on the line scanner described by Jacobs et al.

The experimental data shown in the table below and in FIGS. 4 and 5 indicate a striking improvement in diminishing losses. In these experiments the insulator 60 is cellophane tape. The 20-kilohm per cm. polished PIN diode measures 0.4 mm in the Y direction, 0.5 mm in the X direction, and the length in the Z direction measures on the side adjacent the tape, 1.22 cm. The waveguide is one millimeter square in cross section. The data was taken at a frequency of approximately 76 GHz. The devices are designed for operation at 60–76 GHz.

In the table, the first column is the bias current to the PIN diode in milliamperes. The second and third columns are respectively the attenuation (loss) in dB and the change of phase in degrees with no insulator. The fourth and fifth columns are similarly the attenuation and phase shift with 0.086 mm thick cellophane tape between the waveguide and the PIN diode.

| | No insulator | | With insulator | |
|---|---|---|---|---|
| Bias MA | Attn. dB | Phase Change degrees | Attn. dB | Phase Change degrees |
| 0 | 4.3 | | 2.8 | |
| 50 | 12.0 | 45 | 5.8 | 38 |
| 100 | 13.2 | 76 | 4.5 | 40 |
| 150 | 12.9 | 80 | 4.0 | 46 |
| 200 | 11.8 | 105 | 4.7 | 50 |

Figure 4:
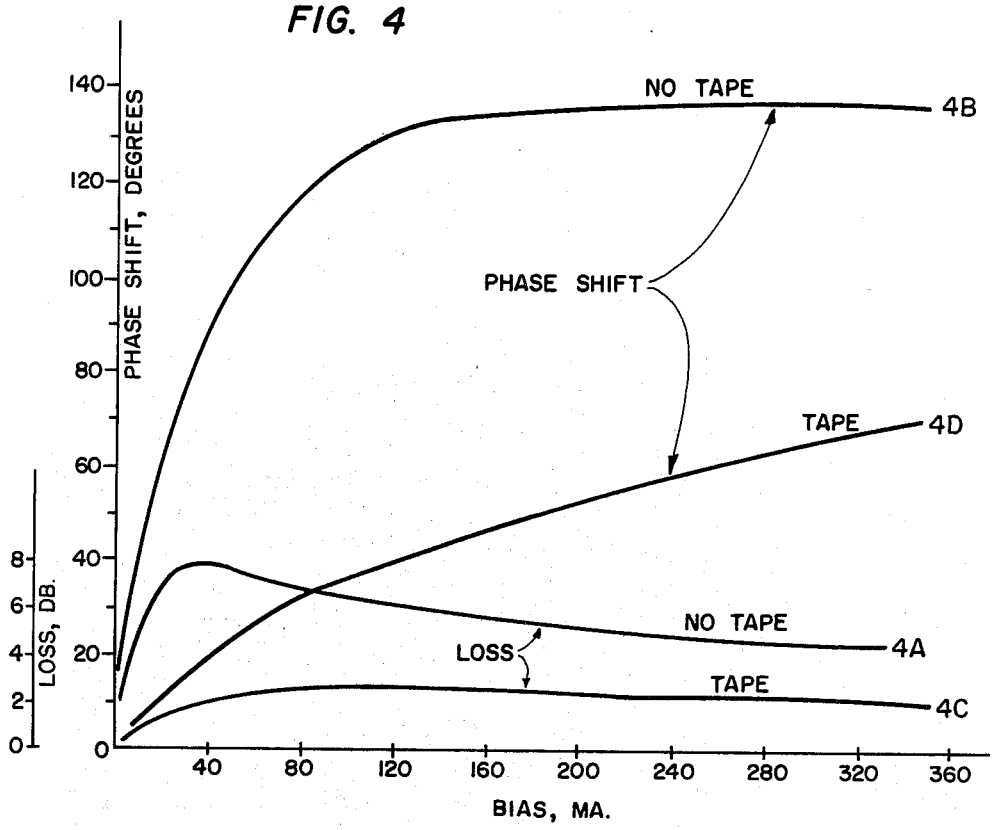
FIGS. 4 and 5 are diagrams of characteristic curves of the variation of phase shift and attenuation as a function of the PIN diode bias current of two different experiments.

FIG. 4 shows the results of another experiment graphically, wherein the width of the PIN diode in the X dimension is 0.4 mm, and the other dimensions are the same as above. Curves 4A and 4B show respectively the attenuation in dB and the change of phase in degrees with no insulation, and curves 4C and 4D show the attenuation and phase change with the cellophane tape between the silicon waveguide and the PIN diode.

Figure 5:
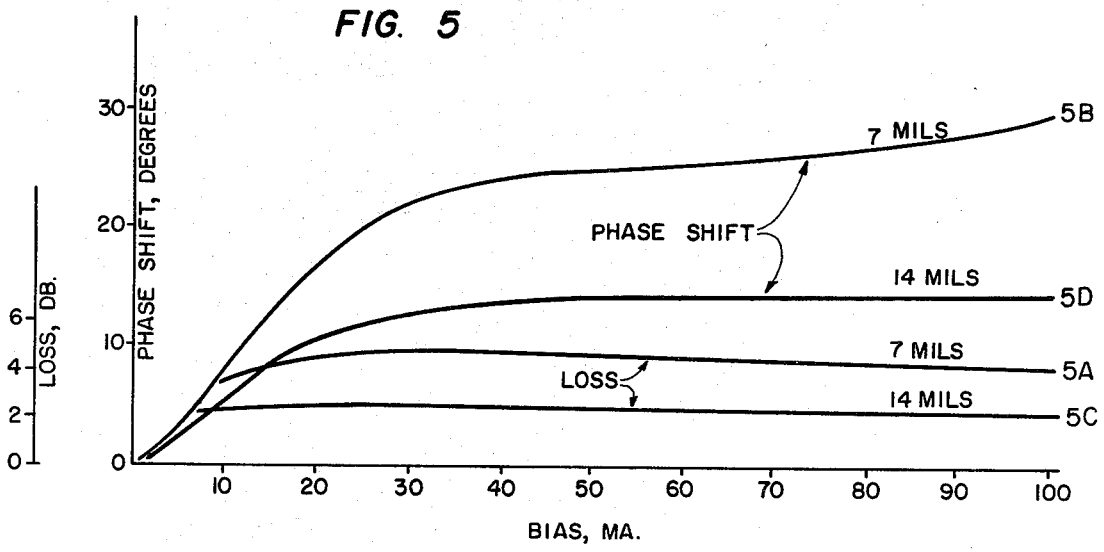

The curves of FIG. 5 illustrate the effect of the tape thickness. Here the width of the PIN diode in the X dimension is 0.675 mm, in the Y dimension is 0.5 mm and in the Z dimension 1.22 cm on the side adjacent the cellophane tape and 1.0 cm at the outer edge. Curves 5A and 5B show respectively the attenuation and phase shift with tape thickness of 0.176 mm; while curves 5C and 5D show respectively the attenuation and phase shift with tape thickness of 0.352 mm.

What is claimed is:

1. A semiconductor waveguide scanning antenna, comprising in combination:

a length of semiconductor waveguide of rectangular cross section adapted to propagate wave energy along a longitudinal axis transverse to said cross section and having a plurality of spaced parallel metallic elements selectively located on one surface of said waveguide along its length which act as perturbations that interact with the propagated wave energy to produce at least a first radiation pattern directed outwardly from said one surface at a predetermined radiation angle;

distributed PIN diode means formed from contiguous layers of semiconductive material located on an adjacent surface of said waveguide which is perpendicular to said one surface, said layers being disposed orthogonally with respect to and projecting outwardly from said adjacent surface, so that the PIN diode means lies entirely outside of the rectangular cross section of the semiconductor waveguide, a dielectric insulator layer disposed between said PIN diode means and said adjacent surface; and means coupled to said PIN diode means for applying a bias potential thereto for controlling the conductivity of said PIN diode means which has the effect of varying the wavelength of said semiconductor waveguide and accordingly the radiation angle of said first radiation pattern.

2. A length of semiconductor waveguide of rectangular cross section adapted to propagate wave energy along a longitudinal axis transverse to said cross section;

distributed PIN diode means formed from contiguous layers of semiconductive material located on one surface of said waveguide, said layers being disposed orthogonally with respect to and projecting outwardly from said one surface, so that the PIN diode means lies entirely outside of the rectangular cross section of the semiconductor waveguide, a dielectric insulator layer disposed between said PIN diode means for applying a bias potential thereto for controlling the conductivity of said PIN diode means which has the effect of varying the wavelength of said semiconductor waveguide and accordingly the phase of said propagated wave energy.

3. Apparatus as set forth in claim 1 or 2, wherein said rectangular cross section of said semiconductor waveguide has substantially equal dimensions; and wherein said PIN diode means in the dimension extending through the layers thereof is substantially thinner than the semiconductor waveguide.

4. Apparatus as set forth in claim 3, wherein said waveguide is composed of silicon.

5. Apparatus as set forth in claim 4, further including second PIN diode means located on the opposite surface of said waveguide with respect to the first said PIN diode means, mounted and biased in a similar manner, and also having a dielectric insulator layer disposed between the second PIN diode means and the waveguide.

* * * * *